United States Patent [19]

Petroski

[11] 3,994,025

[45] Nov. 30, 1976

[54] HAND PROTECTOR

[76] Inventor: Daniel J. Petroski, 2130 Campbell Rd., Houston, Tex. 77055

[22] Filed: June 2, 1975

[21] Appl. No.: 582,903

[52] U.S. Cl. ..... 2/20; 2/161 R

[51] Int. Cl.[2] ..... A41D 13/08

[58] Field of Search ..... 2/20, 159, 160, 161 A, 2/161 R; 294/25

[56] References Cited

UNITED STATES PATENTS

| | | | |
|---|---|---|---|
| 425,887 | 4/1890 | Kohler | 2/20 X |
| 2,084,428 | 6/1937 | Bush | 2/161 A |
| 2,244,445 | 6/1941 | Carson et al. | 2/20 |
| 2,322,710 | 6/1943 | Eisendrath | 2/20 |
| 3,496,573 | 2/1970 | Kuchar et al. | 2/161 A |
| 3,770,270 | 11/1973 | Ingold | 2/161 A X |
| 3,790,168 | 2/1974 | Hashimoto | 2/161 A |

*Primary Examiner*—Werner H. Schroeder
*Assistant Examiner*—Conrad L. Berman
*Attorney, Agent, or Firm*—Arnold, White & Durkee

[57] ABSTRACT

A reversible, ambidextrous glove having a sleeve operable to cover a portion of the palm, back and knuckles of a hand is disclosed. The sleeve extends from about the interstices of the fingers to a location above the thumb. A flap attached to the sleeve by a web defining at least one finger receiving aperture is arranged to be fastened to the sleeve to secure the glove to the hand.

12 Claims, 8 Drawing Figures

HAND PROTECTOR

BACKGROUND OF THE INVENTION

This invention relates generally to a novel hand protector or glove. More particularly, this invention relates to a glove useful either as a work glove or as an athletic glove.

In the past, it has been common to utilize hand protectors for such sports as bowling, tennis, golf, baseball, gymnastics, handball, football, weight lifting, rowing, volleyball, whereupon it is desired to protect primarily the palm portion of the hand. In addition, activities such as boxing and other marshal arts as well as machine maintenance, particularly in connection with automobile engines, require that some protection be afforded to the knuckle portion of the hand. Moreover, it is well known that activities such as chopping wood, bailing hay, and related activities may cause severe blistering of the interior or palm portion of the hands.

A variety of gloves exist in the prior art which are adjustable to accommodate hands of varying widths or thicknesses as well as fingers of varying dimensions. In addition, some gloves are known which provide reinforced zones capable of withstanding extraordinary wear, impact or friction. However, many of these gloves are adapted for either the left or right hands. Whereas known gloves might be suitable for some of the above-listed activities, many such gloves would be unsuitable for other of the activities. Whereas some known gloves may be operable to provide reinforced palm portions, such gloves are not known to be reversible to provide reinforced knuckle protection.

It would, therefore, be desirable to provide a reversible, ambidextrous glove capable of providing protection for all of the above and related activities.

OBJECTS AND SUMMARY OF A PREFERRED EMBODIMENT OF THE INVENTION

It is, therefore, a general object of the present invention to provide a novel hand protector or glove which minimizes or reduces the problems of the type previously noted.

It is a more particular object of the present invention to provide a novel glove which is adjustable to accommodate hands of varying widths and/or thicknesses.

It is yet another object of the present invention to provide a novel glove which is reversible to present a reinforced zone over either the palm portion or the knuckle portion of the hand.

It is still another object of the present invention to provide an ambidextrous, reversible, fully adjustable glove which conforms to the contour of the palm of the hand while affording complete freedom of movement of the thumb with the other fingers.

A glove according to a preferred embodiment of the invention intended to substantially accomplish the foregoing objects includes a sleeve portion for encircling or covering a portion of the palm, back and knuckles of the hand, the sleeve extending from the interstices of the fingers to a location above the wrist and palm of the hand. A flap is attached to the sleeve and is positionable to overlie a portion thereof. This flap is attached to the sleeve by a web defining at least one finger receiving aperture to receive a finger of the hand when the flap is fastened to the sleeve. A fastening means such as VELCRO is provided to connect the flap to the sleeve which serves to secure the glove to the hand. The sleeve itself may be comprised of an elongate strip of material which has been folded around to define a generally cylindrical sleeve member. The opposite ends of this elongate strip may be connected to each other by means of a VELCRO fastener.

Examples of the more important features of this invention have thus been summarized rather broadly in order that the detailed description thereof that follows may be better understood, and in order that the contribution to the art may be better appreciated. There are, of course, additional features of the invention that will be described hereinafter and which will also form the subject of the claims appended hereto. These features and other objects and advantages of the present invention will become apparent with reference to the following detailed description of a preferred embodiment thereof in connection with the accompanying drawings wherein like reference numerals have been applied to like elements, in which:

DETAILED DESCRIPTION

Figure 1:
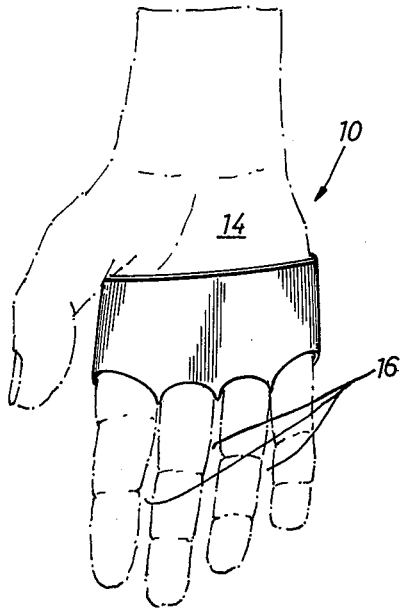
FIG. 1 pictorially depicts a hand carrying a glove of the present invention.

With reference to FIGS. 1–5, there may be seen an ambidextrous, reversible hand covering or glove 10 according to one embodiment of the present invention. There is provided a generally cylindrical main body or sleeve portion 12 for covering a portion of the palm, back and knuckles of a hand 14. The sleeve 12 is positionable to extend from the interstices 16 of the fingers to a location above the wrist and thumb of the hand. The sleeve 12 is formed from a length of flexible material which is conventionally joined at its opposite ends 18 and 20 to an elastic insert 22. It will, of course, be appreciated that the elastic insert 22 renders the sleeve 12 expandable to accommodate hands of varying widths and/or thicknesses.

A flap or tab 24 is attached to the sleeve 12. This tab 24 has a plurality of apertures 26 and 28 which are approximately the same size. These apertures are operable to accommodate the second and third fingers of either hand. A pair of cut-away portions 30 and 32 on the tab 24 are operable to define a portion of a first and fourth finger receiving position. The generally arcuate, cut-away portions 30 and 32, defined respectively by edges 34 and 36 of the tab 24, will define a generally circular aperture when the tab 24 is folded over the sleeve portion 12 as shown in FIG. 2.

A fastening means is required to hold the flap or tab in a locked down position. Whereas a variety of appropriate fastening devices are well known in the art, it has been found that fasteners of the hook and burr type known as VELCRO and available from American Velcro, Inc. of Manchester, Vermont, or Velcro S.A., Lenzerheide of Grisons, Switzerland, are particularly suitable and are preferred. A strip 38 of the hook type VELCRO may be attached by, say, sewing to the tab 24, and a strip 40 of burr VELCRO may be attached to the sleeve 12.

It will, of course, be appreciated that even with the tab portion 24 of the glove 10 secured to the sleeve 12, a satisfactory amount of flexibility will remain in the sleeve portion. Moreover, the fastening of the tab 24 does not significantly impede the lateral flexibility afforded by the elastic strip 22.

Figure 2:
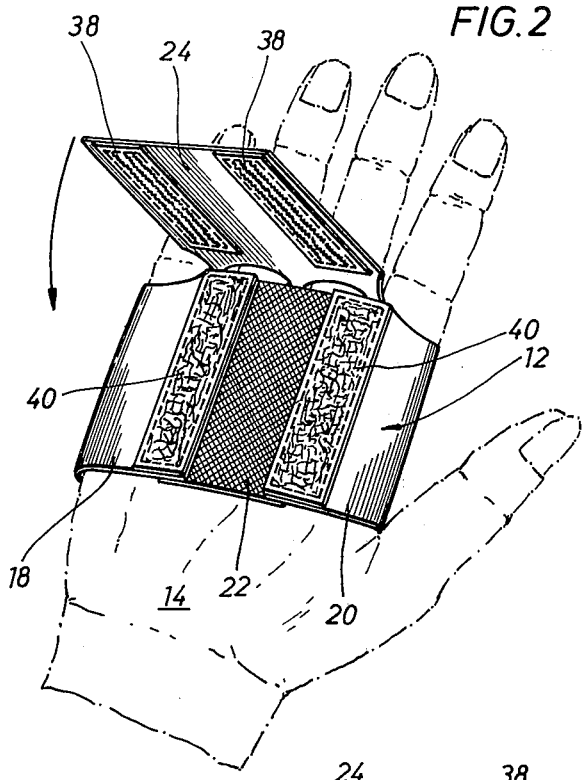
FIG. 2 depicts the glove of FIG. 1 and illustrates an adjustability feature of the glove.
Figure 3:
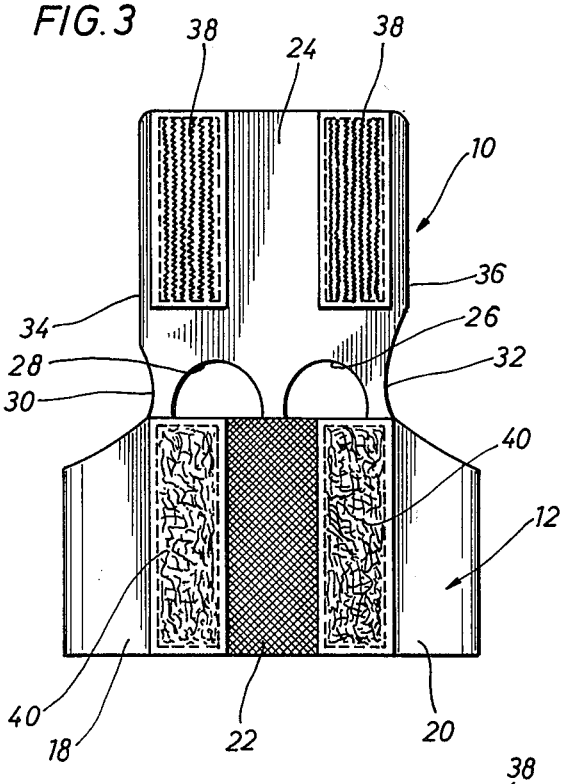
FIG. 3 is a front view of the glove of FIG. 2 prior to an insertion of a hand.
Figure 4:
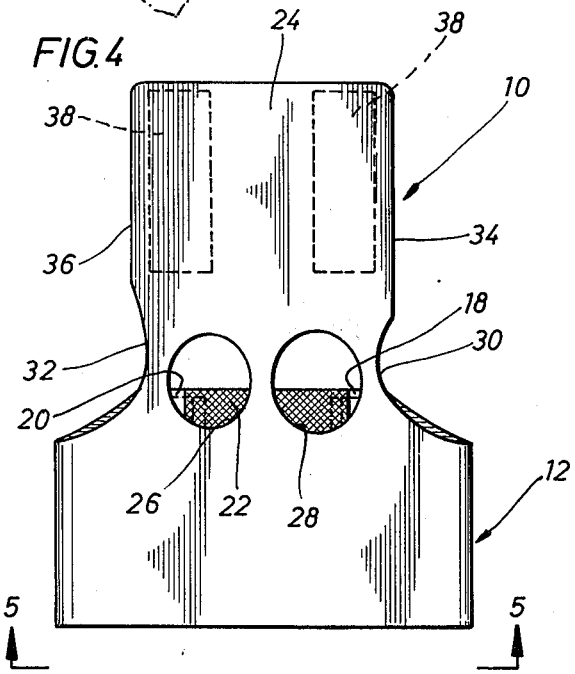
FIG. 4 is a back view of the glove of FIG. 3.
Figure 5:
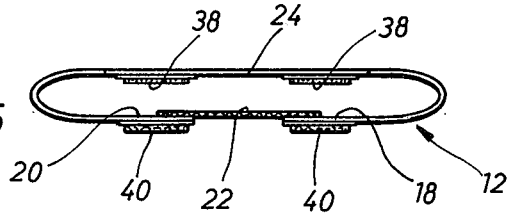
FIG. 5 is a bottom view of the glove of FIG. 4.

The elastic strip 22 may be stitched to the ends 18 and 20 of the strap defining the sleeve so as to place the elastic strip as shown in FIG. 2 in contact with the back portion of the hand. In addition, the VELCRO material may be stitched by any conventional means to the appropriate portions of the glove.

Whereas a variety of materials may be appropriate in the fabrication of a glove according to the present invention, it has been found that leather provides advantages characteristics of flexibility, strength and durability and is therefore a preferred material.

Figure 6:
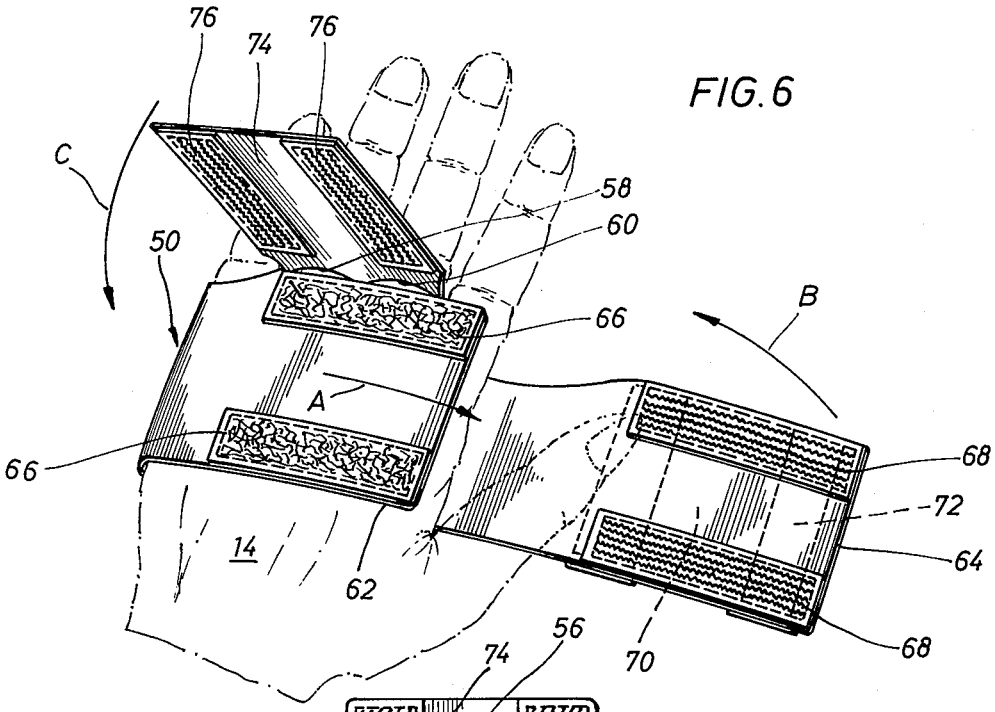
FIG. 6 pictorially depicts an alternative embodiment of the glove of the present invention wherein an adjustability feature is shown.
Figure 7:
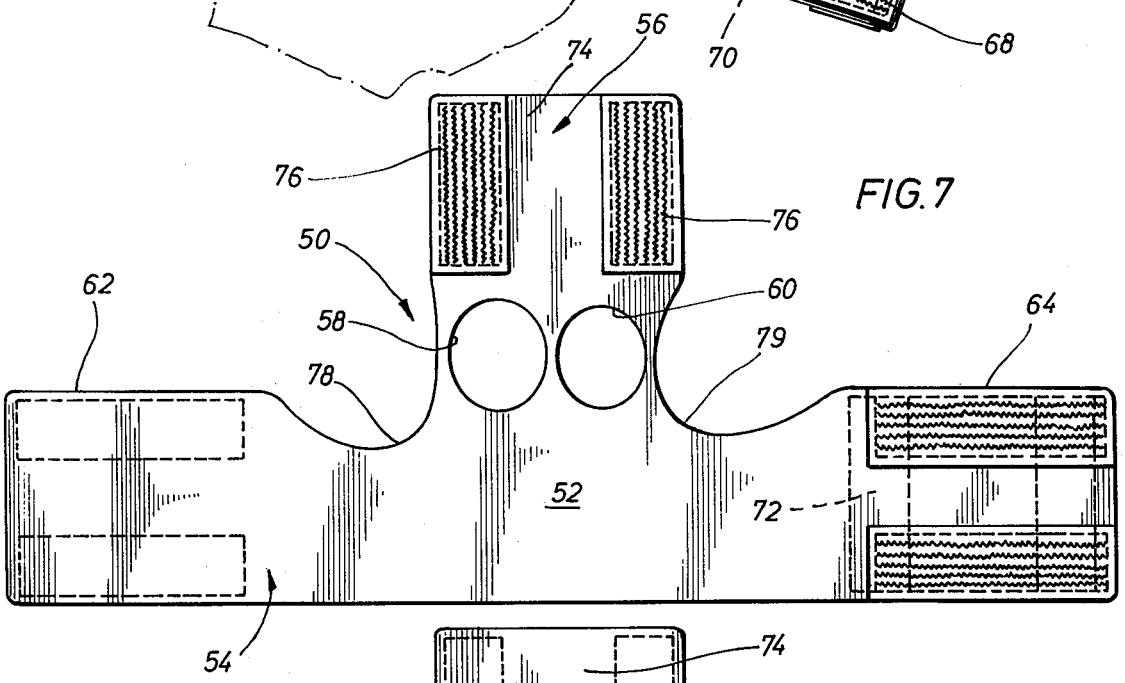
FIG. 7 is a front view of the glove of FIG. 6 prior to insertion of the hand.
Figure 8:
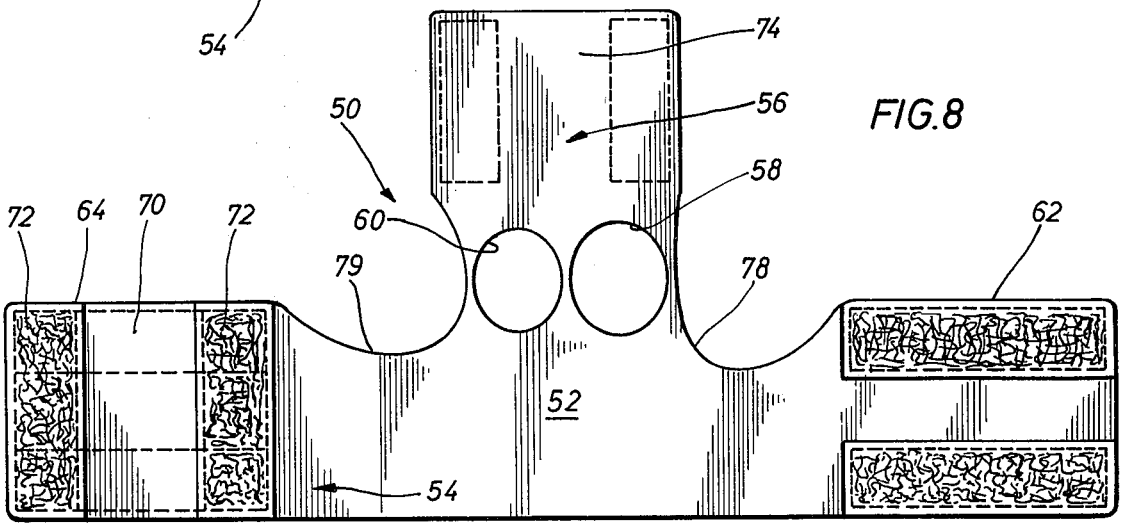
FIG. 8 is a back view of the glove of FIG. 7.

With respect to the embodiment of the invention illustrated in FIGS. 6–8, there may be seen an ambidextrous, reversible hand covering or glove 50 comprising a generally T-shaped strap 52. This T-shaped strap comprises an elongate or "cross" member 54 and a transverse or "vertical" member 56. A pair of finger receiving apertures 58 and 60 are positioned generally at a intersection of the cross member 54 and the vertical member 56. These apertures 58 and 60 are operable to receive the second and third fingers of either hand. The cross member 54 has a first 62 and second 64 end. The first end 62 carries a first fastener comprising a pair of burr type VELCRO strips 66. It will, of course, be appreciated that a variety of fastening devices known in the art may be utilized in the fabrication of a glove according to the present invention. However, as discussed in greater detail below, it has been found that VELCRO provides particularly advantageous characteristics when used in a glove of the present invention.

The second end 64 carries on a side cooperable with the first end 62 a pair of hook type VELCRO strips 68.

As may be seen in FIG. 6, to place the glove 50 on a hand 14 with a reinforced portion of the glove overlying the knuckles, the second and third fingers are inserted into the apertures 58 and 60 of the glove. The first end 62 of the cross member 54 is first placed on the back of the hand 14 as indicated at "A". The second end 64 of the cross member 54 is then folded over the first end 62 in order to bring the VELCRO strips 66 on the first end 62 into contact with the VELCRO strips 68 of the second end 64 as shown at "B" to thereby form a sleeve. It will, of course, be appreciated that the circumference of the sleeve may be adjusted by selection of the position of the VELCRO strips 66 and 68 when the first and second ends are placed together.

The second end 64 of the sleeve carries on its obverse side 70 a pair of burr type VELCRO strips 72 aligned 90° with respect to the VELCRO strips 68 on the other side of the second end 64. This arrangement facilitates the proper arrangement of the ends with the tab 74 defined by the vertical portion 56. The VELCRO strips on the obverse side 70 of the second end 64 are arranged to cooperate with the pair of hook type VELCRO strips 76 on the tab portion 74 of the glove 50 as shown at "C".

Similar to the embodiment illustrated in FIGS. 1–5, there is provided in the embodiment of FIGS. 6–8 a pair of cut-away portions or slots 78 and 79 along an edge of the cross member 54 and vertical member 56.

With the glove 50 in its assembled form, there are provided four finger receiving positions. An inside pair of finger receiving positions are defined by the apertures 58 and 60. An outside pair of finger receiving positions, that is, positions to receive the first and fourth fingers, are defined by the cut-away portions 78 and 79.

SUMMARY OF ADVANTAGES AND SCOPE OF THE INVENTION

It will be appreciated that in constructing a novel hand protector according to the present invention, certain significant advantages are provided.

In particular, gloves according to the present invention are ambidextrous. That is, the glove may be used on either hand. In addition, the gloves are reversible. That is, the glove may be arranged, in the case of the embodiment disclosed in FIGS. 1–5, with a double layer either overlying the knuckles (See FIGS. 1 and 2) or overlying the palm. This double layer is defined by the tab 24 and that portion of the sleeve 12 and elastic 22 underlying the tab.

In connection with the embodiment disclosed in FIGS. 6-8, a triple layer may likewise be positioned either over the knuckles or over the palm of the hand. It has been found that the particular arrangement of VELCRO strips shown both in FIGS. 1–5 and FIGS. 6–8 provide a "cushiony" or impact absorbing surface. That is, with the glove in place over the palm of a hand, the hand may be especially protected from impact during such activities as, say, playing baseball or handball.

With either alternative embodiment, the glove may be snuggly positioned on a hand to facilitate both work and athletic activities. In addition, extra palm protection or knuckle protection may be afforded by the double or triple layered zones of the embodiments of the invention.

Both of these embodiments enable the wearer to maintain substantially full use of his fingers without interference from the glove. Moreover, wrist movement is not impeded regardless of the position of the glove.

Further modifications and alternative embodiments of the glove of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of the parts. For example, equivalent materials may be substituted for those illustrated and described herein, parts may be reversed, and certain features of the invention may be utilized independently of the use of other features, all as would be apparent to one skilled in the art after having the benefit of this description of the invention. Accordingly, it is intended that all such alternatives, modifications and variations which fall within the spirit and scope of the invention as defined in the appended claims be embraced thereby.

What is claimed is:

1. A hand protector comprising:

a main body portion for covering a portion of the palm, back and knuckles of a hand, said main body portion extending from the interstices of the fingers to a location above the wrist and thumb of the hand;

a first end of a flap attached to said main body portion and positionable to overlie a portion thereof, said flap being attached to said main body portion by a web defining at least one finger receiving aperture to receive a finger of the hand when said flap is fastened to said main body portion; and detachable fastening means fastening a second end of said flap to said main body portion.

2. The hand protector of claim 1, wherein said main body portion includes a stretchable insert to provide a stretch-tight fit around the hand.

3. The hand protector of claim 2, wherein said stretchable insert is elastic.

4. The hand protector of claim 1, wherein said fastening means comprises a first zone of hook and burr type fasteners attached to said main body portion and a second zone of hook and burr type fasteners, cooperable with said first zone, attached to said flap.

5. The hand protector of claim 1, wherein said main body portion includes means for adjusting the fit of said main body portion, said adjusting means comprising a first zone of hook and burr type fasteners attached to a first length of said main body portion, and a second zone of hook and burr type fasteners attached to a second length of said main body portion.

6. An ambidextrous and reversible hand protector comprising:

a generally cylindrical main body for covering a portion of the palm, back and knuckles of a hand, said main body being positionable to extend from the interstices of the fingers to a location above the wrist and thumb of the hand, said main body being formed from a length of flexible material joined together at opposite ends to define said generally cylindrical main body;

a flap attached to said main body and positionable to overlie a portion of said main body to provide a double layer zone, said flap being attached to said main body by a web defining a plurality of finger receiving apertures to receive fingers of the hand when said flap is positioned to overlie said main body; and fastening means for fastening said flap to said main body.

7. The hand protector of claim 6 and including an elastic member operably inserted between said opposite ends of said flexible material to provide a stretch-tight fit around the hand.

8. The hand protector of claim 6, wherein said fastening means comprises a first zone of hook and burr type fasteners carried by said main body and a second zone of hook and burr type fasteners, cooperable with said first zone, attached to said flap.

9. An ambidextrous and reversible hand covering comprising:

a generally T-shaped strap comprising a cross member and a vertical member, said strap having a pair of finger receiving apertures positioned generally at an intersection of said cross member and said vertical member, said pair of apertures being operable to receive the second and third fingers of a hand;

first fastening means carried by a first end of said cross member, second fastening means carried by a second end of said cross member, said first and said second fastening means being cooperable to fasten together said ends of said cross members when said cross members are overlapped to define a hand receiving sleeve for receiving a portion of the palm, back and knuckles of a hand, said sleeve being operable to extend from about the knuckles to a location above the thumb and wrist of the hand; and third fastening means carried by said vertical member, fourth fastening means carried by said sleeve formed by said now overlapped and fastened together ends of said cross members, said third and fourth fastening means being cooperable to fasten an end of said vertical member to said sleeve to provide an inside and an outside pair of finger receiving positions, said inside pair of finger receiving positions being defined by said apertures, said outside pair of finger receiving positions, operable to receive the first and fourth fingers of a hand, being defined by an edge of said sleeve and said vertical member.

10. The hand protector of claim 9, wherein said first and second ends of said cross member and said end of said vertical member define a triple layer zone.

11. The hand protector of claim 9, wherein said first, second, third and fourth fastening means comprises hook and burr type fasteners.

12. The hand protector of claim 11, wherein said second end of said cross member carries said second fastening means on one side and said fourth fastening means on an opposite side.

* * * * *